United States Patent [19]

Crisci

[11] Patent Number: 4,801,032

[45] Date of Patent: Jan. 31, 1989

[54] CLOSURE FOR CONTAINERS WITH CONVENIENT TEAR OFF SKIRT

[75] Inventor: Harry E. Crisci, New Castle, Pa.

[73] Assignee: Northern Engineering & Plastics Corp., New Castle, Pa.

[21] Appl. No.: 88,808

[22] Filed: Aug. 24, 1987

[51] Int. Cl.[4] ..... B65D 41/46

[52] U.S. Cl. ..... 215/256

[58] Field of Search ..... 215/256; 220/270, 276

[56] References Cited

U.S. PATENT DOCUMENTS

| | | | |
|---|---|---|---|
| 1,881,529 | 10/1932 | Hammer | 215/256 |
| 3,019,936 | 2/1962 | Maulaz | 220/270 |
| 3,913,771 | 10/1975 | Acton et al. | 215/256 |
| 4,066,182 | 1/1978 | Allen et al. | 215/256 |
| 4,387,818 | 6/1983 | Conti | 215/256 |
| 4,561,553 | 12/1985 | Crisci | 215/256 |
| 4,589,561 | 5/1986 | Crisci | 215/256 |
| 4,658,977 | 4/1987 | Crisci | 215/256 |
| 4,667,839 | 5/1987 | Crisci | 215/256 |

FOREIGN PATENT DOCUMENTS

| | | | |
|---|---|---|---|
| 2442341 | 4/1975 | Fed. Rep. of Germany | 215/256 |

*Primary Examiner*—Donald F. Norton

*Attorney, Agent, or Firm*—Harpman & Harpman

[57] ABSTRACT

A closure for containers, such as a blow molded jug having a neck surrounding an opening therein and a pair of vertically spaced fastening configurations on the exterior thereof, the closure having a cap portion and an annular tear skirt depending therefrom. The cap portion and the tear skirt having vertically spaced fastening configurations and a frangible annular wall joining the tear skirt and the cap portion between said fastening configurations. The tear skirt having a vertically positioned frangible wall and a pull tab formed integrally with the tear skirt at one side of said vertical frangible wall and of a height equal to said tear skirt. Vertically positioned ribs on the opposite sides of said pull tab facilitating manual grasping of said pull tab and removing the tear skirt from the closure so as to permit the closure to be removed from the container on which it is applied.

3 Claims, 2 Drawing Sheets

CLOSURE FOR CONTAINERS WITH CONVENIENT TEAR OFF SKIRT

BACKGROUND OF THE INVENTION

1. Technical Field

This invention relates to tamper indicating closures for containers, such as blow molded plastic jugs which are widely used in the dairy industry for the expendable packaging of dairy products, such as milk.

2. Description of Prior Art

Prior closures of this type may be seen in U.S. Pat. Nos. 4,561,553, 4,589,561, 4,658,977 and 4,667,839.

The present invention provides a novel pull tab integrally formed with a tear skirt and an associated outwardly extending annular flange thereof. The pull tab being of the same height and thickness dimensions as the tear skirt and having several horizontally spaced vertical ribs defining sharp configurations in its opposite sides and an enlarged cross-sectionally rounded end portion in effect forming a full size extension of the tear skirt.

SUMMARY OF THE INVENTION

A tamper indicating closure for containers, such as blow molded jugs with appropriate neck configurations takes the form of a cap portion having a top and an annular depending flange on its peripheral edge radially spaced with respect to an annular sealing flange. An inturned fastening rib is formed on the inner surface of the annular depending flange of the cap portion adjacent an area of larger diameter in which a first annular groove is formed in the inner surface thereof so as to define a thin frangible connection with the remaining portion of the depending annular flange which forms a tear skirt. A second annular groove is formed in the tear skirt and forms a second fastening configuration. An enlarged pull tab both with respect to height and length is integrally formed with the tear skirt adjacent a vertically positioned groove forming a frangible wall in the tear skirt extending between its peripheral edge and the first annular groove therein. The opposite surfaces of the enlarged pull tab are provided with transverse sharpened ribs characterized by oppositely disposed curved valleys therebetween emphasizing the sharpened ribs together with a cross-sectionally rounded outer most end section both of which enable the enlarged pull tab to be very easily grasped and pulled as necessary to separate the tear skirt from the cap portion of the closure.

DESCRIPTION OF THE PREFERRED EMBODIMENT

Figure 1:
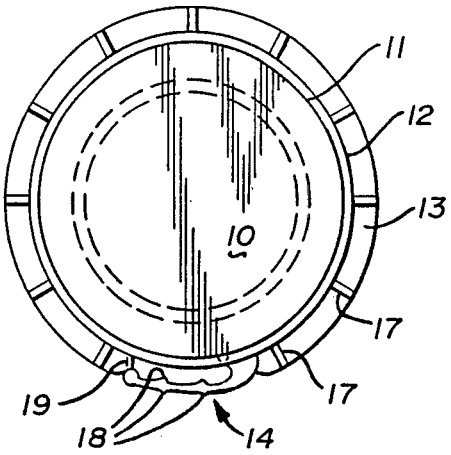
FIG. 1 is a top plan view of the tamper indicating closure.
Figure 2:
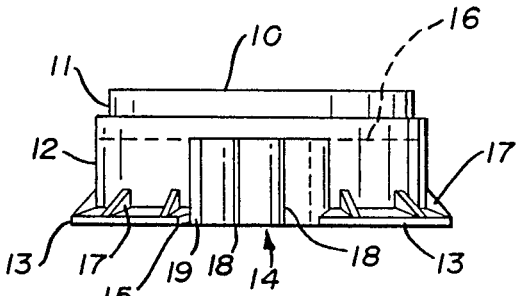
FIG. 2 is a side elevation thereof.

By referring to the drawings and FIGS. 1 and 2 in particular a top plan view and a side elevation of the tamper indicating closure with the enlarged pull tab and tear skirt may be seen. The closure including a top portion 10 with a depending annular flange of different diameters, one of which forms a relatively short first portion 11 and the other forms a larger diameter portion 12 of the depending annular flange. The lower edge of the larger portion 12 of the depending annular flange has an out turned angular annular flange 13 formed on a majority of its annular lower edge. An enlarged pull tab 14 is integrally attached to the lower portion 12 of the depending annular flange of the closure and extends from the lower peripheral edge 15 of the lower portion 12 to an annular frangible wall 16. A plurality of circumferentially spaced gussets 17 are positioned between the lower portion 12 of the depending annular flange of the closure and the out turned angular flange 13 thereof except in that portion thereof adjacent the enlarged pull tab 14. In FIGS. 1 and 2 of the drawings the enlarged pull tab will be seen to have at least a pair of transversely positioned sharp ribs 18 arranged in oppositely disposed relation on its outer and inner sides together with a cross-sectionally rounded end 19 which is attached by a thin frangible member 20 to the lower portion 12 of the depending annular flange of the closure. It will be observed that the enlarged pull tab 14 occupies an area of the closure in which the out turned angular flange 13 is omitted.

Figure 3:
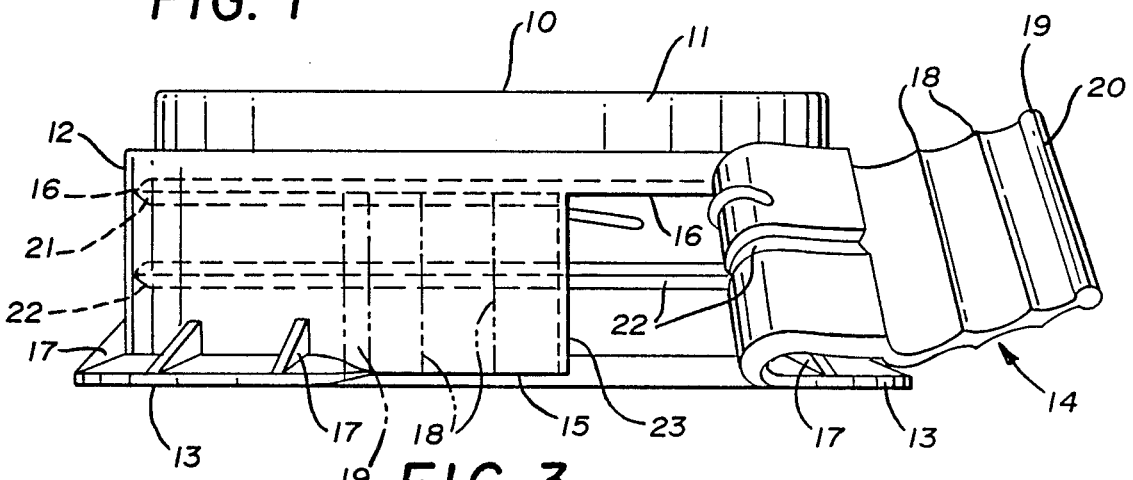
FIG. 3 is an enlarged side elevation showing a portion of the tear skirt and pull tab partially separated therefrom.
Figure 4:
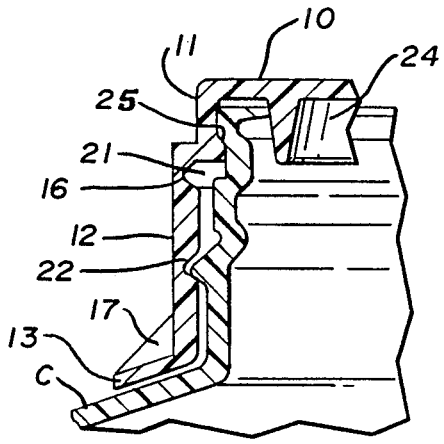
FIG. 4 is a vertical section through a portion of the closure and a portion of a neck of a container.

By referring now to FIG. 3 of the drawings a greatly enlarged side elevation of the tamper indicating closure with the enlarged pull tab may be seen and it will be observed that a pair of annular grooves 21 and 22 are formed in the inner wall surface of the lower portion 12 of the depending annular flange of the closure. The annular groove 21 forms a thin frangible wall 16 between the upper most portion of the depending annular flange and the lower portion thereof and the annular groove 22 forms a fastening configuration registerable with an annular rib on a container C as seen in FIG. 4 of the drawings. Still referring to FIG. 3 of the drawings it will be seen that the enlarged pull tab 14 and an adjacent portion of the depending annular flange defining a tear skirt have been separated from the closure by grasping the enlarged pull tab 14 and pulling the same outwardly and to the right by the separation of a thin frangible wall 23 which extends vertically from the peripheral edge 15 of the annular flange of the closure to the thin frangible wall 16 defined by the annular groove 21 which defines the tear skirt portion of the closure.

Figure 5:
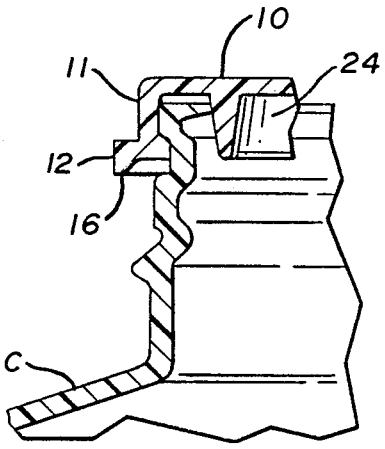
FIG. 5 is a vertical section through a portion of the closure with the tear skirt removed.

By referring now to FIG. 4 of the drawing, the top portion 10 of the closure will be seen to be provided with a depending annular sealing flange 24 which registers in sealing relation with an access opening in the upper end of the neck of the container C and it will be observed that the first fastening configuration of the closure takes the form of an inturned annular rib 25 which registers beneath an out turned annular rib on the neck portion of the container C. In FIG. 5 of the drawings the cap portion of the closure may be seen in fastened relation to the neck portion of the container C as the device appears after the enlarged pull tab 14 has been grasped and the tear skirt which comprises the majority of the depending annular flange of the closure removed therefrom.

Figure 6:
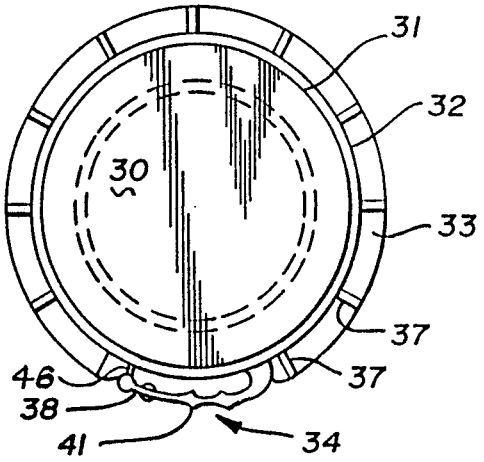
FIG. 6 is a top plan view of a modified closure.
Figure 7:
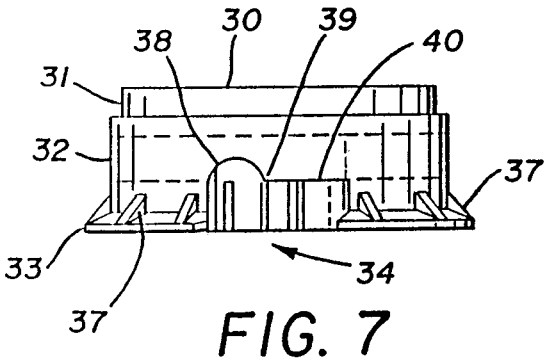
FIG. 7 is a side elevation thereof.
Figure 8:
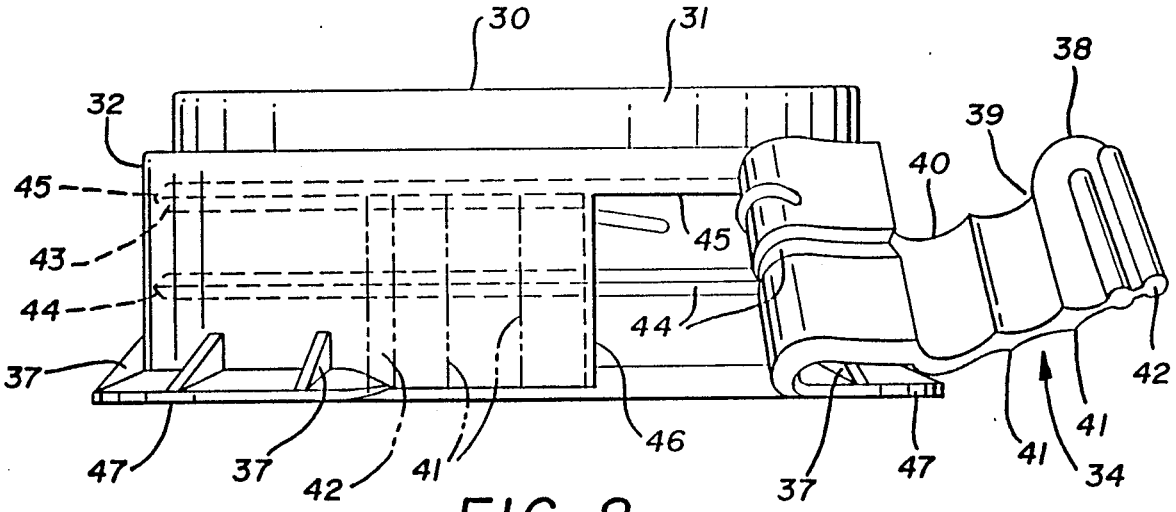
FIG. 8 is an enlarged side elevation of the modified closure showing a portion of the tear skirt partially separated thereon.

A modified enlarged pull tab on a tamper indicating closure is illustrated in FIGS. 6, 7 and 8 in which the modified closure includes a top portion 30 with a depending annular flange of different diameters, one of which forms a relatively short first portion 31 and the other forms a larger diameter portion 32. The lower edge of the larger portion 32 has an outturned angular flange 33 on a majority of its lower edge. An enlarged pull tab 34 is integrally attached to the lower portion 32 and extends from the lower peripheral edge 35 thereof to an annular frangible wall 36. A plurality of circumferentially spaced gussets 37 are positioned between the lower portion 32 of the depending annular flange of the closure and the outturned angular flange 33 thereof except in that portion thereof adjacent the enlarged pull tab 34.

In FIGS. 6 and 7 of the drawings, the enlarged pull tab will be seen to have an end portion 38 of increased height with respect to the remainder thereof, the upper portion of the end portion 38 being bowed upwardly to form a rounded offset with respect to a continuing upper horizontal surface 40. The pull tab 34 has at least a pair of transversely positioned sharp ribs 41 arranged in oppositely disposed relation on its outer and inner sides together with a cross sectionally rounded end 42 which is attached by a thin frangible member 43 to the lower portion 32 of the depending annular flange of the closure.

By referring to FIGS. 6 and 7 of the drawings, it will be seen that an offset 39 is formed between the bowed upper surface 38 and the upper horizontal surface 40 of the pull tab 34 that enables a person grasping the enlarged pull tab 34 to obtain a firmer hold thereon due to its unique configuration.

By referring now to FIG. 8 of the drawings, a greatly enlarged side elevation of the modified closure may be seen and it will be observed that a pair of annular grooves 43 and 44 are formed in the inner wall surface of the lower portion 32 of the depending annular flange of the closure. The annular groove 43 forms a thin frangible wall 45 between the uppermost portion of the depending annular flange 32 and the lower portion thereof and the annular groove 44 forms a fastening configuration registrable with an annular rib on a container similar to that hereinbefore referred to in connection with FIG. 4 of the drawings.

Still referring to FIG. 8 of the drawings it will be seen that the enlarged pull tab 34 and an adjacent portion of the depending annular flange 32 beneath the frangible wall 45 define a tear skirt and that a portion thereof has been separated from the closure by grasping the enlarged pull tab 34 and pulling the same upwardly and to the right by the separation of a thin frangible wall 46 which extends vertically from the peripheral edge 47 of the annular flange of the closure to the thin frangible wall 45 defined by the annular groove 43 which defines the upper edge of the tear skirt portion of the closure.

It will thus be seen that the enlarged pull tab 34 with its upstanding upwardly bowed end portion 38 and the resulting offset 39 between the same and the horizontal top portion 40 of the pull tab provide a unique and very practical configuration facilitating the pulling away of the tear skirt of the closure as is necessary to remove the closure from a container.

Those skilled in the art will observe that the closure for containers with the convenient tear-off skirt disclosed herein is adapted to be snap-fit on a container by a downward vertical movement imparted to the closure and that in order that the closure can be removed the enlarged pull tab 14 must be grasped and the tear skirt portion of the depending annular flange removed to free the annular groove comprising a fastening configuration from the matching or registering annular rib on the neck of the container on which the closure has been positioned. The removal of the tear skirt from the closure is greatly facilitated by the provision of the enlarged pull tab 14 and its integral formation with the tear skirt. The construction and detailing of the closure insures easy and rapid removal of the tear skirt and avoids the problems heretofore experienced with tear skirt closures having relatively small pull tabs attached to only a portion of the tear skirt which frequently separated from the tear skirt before the tear skirt had been separated from the remainder of the closure.

It will thus be seen that a substantially improved tamper-indicating closure for containers has been disclosed which incorporates a tear skirt incorporating an enlarged pull tab with a novel surface configuration greatly facilitating grasping the same and removing the tear skirt.

Having thus described my invention, what I claim is:

1. An improvement in a resilient molded plastic closure for a container of the type having a neck surrounding an opening to the container and having dual closure retaining means on the exterior of said neck; said closure comprising a cap for covering said opening to said container, a depending annular flange on the peripheral edge of said cap, closure retaining means in said depending annular flange, an annular groove in said depending annular flange adjacent said cap forming an annular frangible wall defining a continuous tear skirt therebelow; the improvement comprising: a vertically positioned frangible wall formed in said depending annular flange and extending from a lower edge thereof to said annular frangible wall so as to form means for separating said tear skirt, an enlarged pull tab integrally formed with said tear skirt on one side of said vertically positioned frangible wall and extending vertically from the lower edge of said tear skirt to said annular frangible wall whereby said enlarged pull tab defines an extension of one end of said tear skirt of size and shape enabling it to be easily manually engaged and moved so as to remove said tear skirt from said closure.

2. An improvement in a resilient molded plastic closure for a container of the type having a neck surrounding an opening to the container and having dual closure retaining means on the exterior of said neck; said closure comprising a cap for covering said opening to said container, a first depending annular flange of a known diameter and height on the peripheral edge of said cap and a second depending annular flange of a larger diameter and substantially greater height than said first depending annular flange positioned on said first depending annular flange, said first and second depending annular flanges surrounding said neck, closure retaining means in said second depending annular flange adjacent an upper edge thereof forming an annular frangible wall defining a tear skirt therebelow; the improvement comprising: a vertically positioned frangible wall formed in said second depending annular flange and extending from a lower edge thereof to said annular frangible wall so as to form means for separating said tear skirt, an enlarged pull tab integrally formed with said tear skirt so as to extend from the lower edge of said tear skirt to said annular frangible wall whereby said enlarged pull tab defines an outwardly offset extension of one end of said tear skirt of the same height as said tear skirt and of a size enabling it to be easily manually engaged and moved so as to remove said tear skirt from said closure.

3. The improvement in a resilient molded plastic closure set forth in claim 2 and wherein the outer end of said enlarged pull tab is of a greater height than the intermediate portion thereof so as to define a horizontal offset therein.

* * * * *